US006223802B1

(12) United States Patent
Colson

(10) Patent No.: US 6,223,802 B1
(45) Date of Patent: May 1, 2001

(54) CONTROL SYSTEM FOR COVERINGS FOR ARCHITECTURAL OPENINGS

(75) Inventor: Wendell B. Colson, Weston, MA (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 0 days.

(21) Appl. No.: 09/641,320

(22) Filed: Aug. 18, 2000

Related U.S. Application Data

(63) Continuation of application No. 09/139,806, filed on Aug. 25, 1998, now Pat. No. 6,129,131.

(60) Provisional application No. 60/066,886, filed on Nov. 26, 1997.

(51) Int. Cl.[7] ..... A47H 5/02

(52) U.S. Cl. ..... 160/84.02; 160/8; 160/171 R; 160/296; 160/308

(58) Field of Search ..... 160/84.02, 84.04, 160/84.05, 84.06, 171 R, 170 R, 8, 319, 296, 291, 298, 308, 307; 192/41 S, 8 C

(56) References Cited

U.S. PATENT DOCUMENTS 2,579,144 * 12/1951 Griesser ..... 160/170 R X
2,732,010 * 1/1956 Griesser ..... 160/170 R
4,372,432 * 2/1983 Waine et al. ..... 160/307 X
4,492,261 * 1/1985 Chong ..... 160/319
5,566,741 * 10/1996 Ogawara et al. ..... 160/308 X
5,791,393 * 8/1998 Judkins ..... 160/308 X

* cited by examiner

*Primary Examiner*—David M. Purol
(74) *Attorney, Agent, or Firm*—Dorsey & Whitney LLP

(57) ABSTRACT

A control system for a vertically moveable covering for an architectural opening includes a uni-directional drive assembly that is operated with a single pull element such that upon pulling of the pull element, the covering can be raised in increments. A clutch/brake assembly selectively prevents the covering from dropping by gravity between pulling strokes on the pulling element, but a release of the brake allows the shade to drop by gravity from its retracted position to any degree of extension. A governor is further provided to regulate the rate at which the covering drops by gravity. A cord lift system which is operated by the main drive assembly and the clutch/brake assembly includes a rotatable and axially slidable spool about which a lift cord can be wound. The lift cord has one end anchored to the spool and its opposite end extended through a supporting bracket for the spool and downwardly through the covering where the opposite end is anchored to a bottom rail such that a wrapping of the lift cord about the spool lifts the bottom rail thereby causing the covering to be raised adjacent to the lift spool. The lift cord is tangentially fed to the lift spool and forced into an angular wrap on the spool while an outer shell spaced a small distance from the spool prevents multiple wraps so that the lift cord does not become tangled. A return spring biases the spool in one direction to facilitate a controlled movement of the covering from a retracted to an extended position.

6 Claims, 11 Drawing Sheets

38
10
10
9
9
8
8
7
7
6
6
74
56
70
84
86
100
82
80
72
184
74
64
104
46
88
186
184
178
180
48
92
60
116
188
194
190
192
176
174
94
134
196
162
152
106
96
58
108
168
164
118
138
66
150
172
114
98
142
166
154
110
172
140
144
112
156
68
200
54
148
146
160
202
158
148
124
126
40
128
130
132
115
122

A
238
236
227
226
224
218
212
210
40
214
220
222
30
206
208
216
234'

232
230
240
242
216
228
234

216
232
230
240
234
14
14
228
242

CONTROL SYSTEM FOR COVERINGS FOR ARCHITECTURAL OPENINGS

CROSS-REFERENCE TO RELATED APPLICATION

This application is a continuation of U.S. application Ser. No. 09/139,806, filed Aug. 25, 1998 now U.S. Pat. No. 6,129,131, and relates to and claims the benefit of U.S. provisional patent application Ser. No. 60/066,886, filed Nov. 26, 1997. Each of the above-identified patent applications is hereby incorporated by reference as if fully disclosed herein.

BACKGROUND OF THE INVENTION

1. Field of the Invention

The present invention relates to control systems for coverings for architectural openings and the like and, more particularly, to a uni-directionally driven pull system that drives a lift cord system for moving the covering between extended and retracted positions.

2. Description of the Relevant Art

Coverings for architectural openings such as windows, doors, archways and the like take numerous forms including conventional draperies, horizontal Venetian blinds, vertical blinds, roll up shades and numerous other coverings that resemble or define modifications of the afore noted standard coverings. The control systems utilized to operate the coverings sometimes vary depending upon the type of covering so that a roll up shade, for example, would normally have a different control system than a vertical blind or a horizontal Venetian blind. Most control systems are operated with pull cords, pull tapes, or tilt wands which hang from an end of a headrail and are manipulated by a human operator to move the covering between extended and retracted positions relative to the architectural opening in which it is mounted. The suspended cords or wands may also tilt slats or vanes in the covering while the covering is extended across the architectural opening so that the slats or vanes can be rotated about longitudinal axes between open and closed positions to permit the passage of vision and light through the covering.

When pull cords or pull tapes are utilized, they are frequently endless thereby defining a loop of cord or tape at one end of the headrail and loops of this type have presented problems in inadvertently causing physical harm to infants and young children who may put a body part within the loop and get caught in the loop.

There has been a considerable amount of activity in recent years designed to remove the inherent danger in endless pull cords to young children and by way of example, the endless cords may be divided into two distinct cords so that no loop is present. The ends of such a divided cord may also be releasably connected so that under predetermined conditions or pressures, the ends of the cord will become separated to avoid harm to an infant.

It is to provide a new and improved approach to the endless cord problem and to provide an otherwise improved control system for a covering for an architectural opening that the present invention has been developed.

SUMMARY OF THE INVENTION

The present invention resides in an unique approach to solving the closed loop pull tape or cord problem by utilizing a single pull tape, cord, or handle as opposed to an endless loop or two adjacent pull tapes or cords to drive the system.

The single pull tape, cord, or handle is utilized to drive a uni-directional pull system that intermittently rotates a drive shaft in one direction. The drive shaft can be used in connection with various types of architectural coverings but for purposes of the present disclosure it is described in connection with a covering with lift cords and, more specifically, with a unique lift system in which lift cords associated with the covering are operatively wrapped around spools rotated by the drive shaft to lift a covering from an extended lowered position to a retracted raised position adjacent the top of the architectural opening. Gravity is utilized to lower the covering from the retracted position to the extended position.

The lift system component and the pull system component of the present invention are operatively interconnected to effect the desired operation of the covering. The lift system component cooperates with one or more conventional lift cords that extend through or are adjacent to the sheet or other component of the covering that extends across the opening and are attached to a lower edge or bottom rail of the covering sheet or the like. The lift cords are secured at their upper end to associated cord spools that are rotatably driven by the drive shaft. Each lift cord is fed onto a cord spool tangentially and at an acute angle so that the cord wraps smoothly about the spool when the covering is being raised to its retracted position. The cord spool is mounted for sliding movement along its rotative axis so that the cord can be fed to the spool from a single location and the spool is caused to be slid along its rotational axis by the engagement of each wrap of cord against a previous wrap. A resilient member, such as a spring or a foam bushing, yieldingly resists sliding movement of the cord spool as the cord is being wrapped therearound and serves to return the cord spool to a beginning position as the blind is lowered to its extended position. An outer cylindrical shell surrounds the cord spool and is spaced from the cord spool a distance that is only slightly greater than the diameter of the cord so that the cord is prevented from overlapping itself causing tangling of the cord resulting in a malfunction of the lift system.

The pull system component of the present invention, which in the disclosed embodiment is utilized to rotate the drive shaft that in turn rotates the cord spools, includes a main drive assembly and a clutch/brake assembly. The main drive assembly has a drive spool about which a pull tape or pull cord is wrapped with the drive spool being operatively connected to a spiral spring that biases the drive spool in one direction toward a starting position. For purposes of the present disclosure, the pull element of the system will be referred to as a pull tape even though a pull cord or a handle could also be utilized. The spiral spring is tensioned as the pull tape is extended or unwrapped from the drive spool rotating the drive spool in a first direction from its starting position. The spiral spring serves to automatically return the drive spool to its starting position once the pull tape is no longer being unwrapped and the reverse rotation of the drive spool causes the pull tape to be rewrapped onto the drive spool.

The drive spool is axially aligned with an independent driven member having a diameter slightly less than that of the drive spool. The drive spool and driven member are axially aligned with a cylindrical cavity in a housing for the pull system and a clutch spring cooperates with the drive spool, the driven member and the cylindrical cavity in selectively effecting rotation of the driven member in only the first direction when the drive spool is rotated in the first direction as is caused by an unwinding of the pull tape from the drive spool. Rotation of the drive spool in the opposite or second direction does not drive or rotate the driven member due to the clutch spring. In fact, the driven member is allowed to be freewheeling relative to the drive spool when the drive spool rotates in the second direction so that the alternating direction of rotational movement of the drive spool caused by the unwinding and rewinding of the pull tape affects only uni-directional rotation of the driven member. The uni-directional rotation of the driven member is operative to lift the covering from the extended to the retracted position as will be explained hereafter.

It will be appreciated that, at the end of a drive cycle, as when the pull tape has been fully extended and unwound from the drive spool, the covering will have been lifted a predetermined amount which will typically be less than a full retraction of the covering. To prevent the covering from dropping by gravity during a re-wind cycle, as when the pull tape is being rewound onto the drive spool and the driven member is operatively disconnected from the drive spool, the pull system includes a clutch/brake assembly that selectively prevents rotation of the driven member in the opposite or second direction.

The clutch/brake assembly includes a second spring clutch that is operatively connected to the driven member to grip the driven member when it would otherwise be allowed to rotate in the second direction or the direction in which the covering would drop toward an extended position. The second clutch spring itself is prevented from rotating in the opposite direction by a brake operatively coupled to the spring that is manually operable and movable between operative and inoperative positions. In the operative position, the second clutch spring is prevented from rotating in the second direction which thereby prevents the covering from moving from a retracted toward an extended position which would otherwise be caused by gravity. When the brake is rendered inoperative, however, the second clutch spring is allowed to rotate with the driven member in the opposite direction thereby allowing the covering to drop from a retracted position toward an extended position. The brake is manually moved by lateral movement of the pull tape which passes through a brake activator so that an operator of the control system of the present invention can easily activate or deactivate the brake by a simple manipulation of the pull tape.

A governor forms a part of the clutch/brake assembly to restrict the speed at which the driven member can rotate in the second direction so as to prevent the covering from dropping too rapidly from the retracted to the extended position.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

CONTROL SYSTEM

Figure 1:
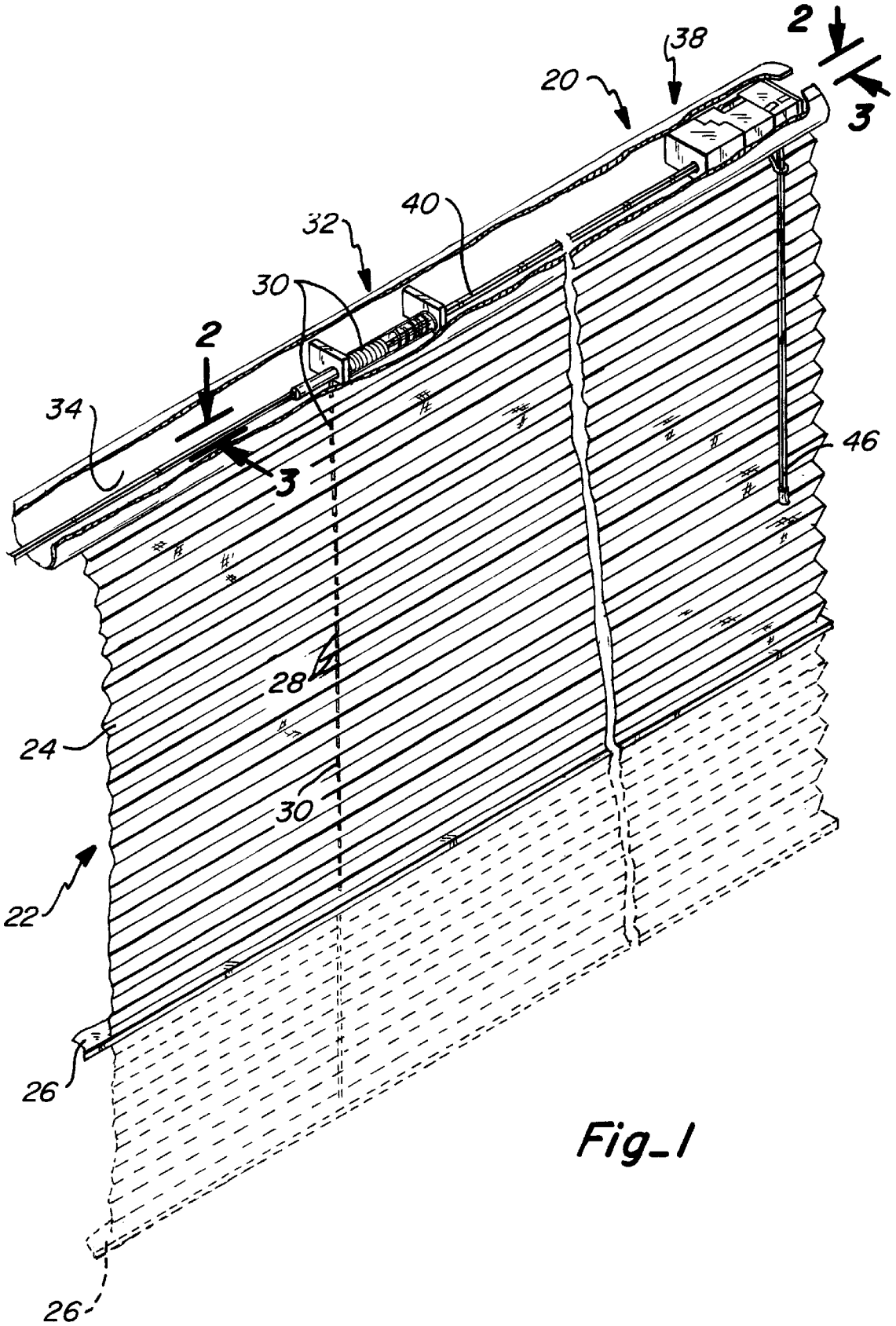
FIG. 1 is a fragmentary isometric with parts removed for clarity illustrating the control system of the present invention in operative association with a roll up covering for an architectural opening.

The control system 20 of the present invention is shown in FIG. 1 incorporated into a covering 22 for an architectural opening such as a window, door, archway, or the like. The covering illustrated in FIG. 1 is a conventional pleated shade having a sheet of material 24 that can be extended downwardly across the architectural opening or folded upwardly into a retracted position adjacent the top of the architectural opening. The pleated shade is formed from the sheet of material which has been alternately reverse folded in a conventional manner along horizontal fold lines to define forwardly and rearwardly directed pleats and the covering has a weighted bottom rail 26 secured along the lower edge of the sheet material. The shade is provided with at least two vertically aligned sets of holes 28 (only one set being shown) in the sheet material through which lift cords 30 extend in a conventional manner with the lower end of the lift cords being secured to the bottom rail 26 of the shade. The upper ends of the lift cords are secured to the lift system component 32 of the control system of the present invention for manipulation in a manner to be described hereafter. As will be appreciated with the description hereafter, the shade is retracted upwardly by pulling upwardly on the lift cords 30 which lifts the bottom rail and causes the pleats in the shade to fold or gather upon themselves into a neatly stacked compact bundle adjacent the top of the architectural opening. Extending the lift cord, of course, allows the shade to extend downwardly by gravity across the opening as the pleats are unstacked. FIG. 1 shows the shade partially extended with a full extension of the shade shown in dashed line.

It will also be appreciated from the description that follows that while the control system of the present invention is disclosed in connection with a pleated shade of the type that is gathered or folded upwardly into a retracted position, the system would also find use in horizontal Venetian blinds, honeycomb cellular shades, or other similar coverings wherein lift cords are utilized to lift the bottom rail of the covering to move the covering from a lowered extended position to a raised retracted position. The pull system component, to be described later, of the control system with some modification might also be used with roll up shades, some cellular shades or other coverings where a rotational drive system was desired or usable as will be apparent to those skilled in the art.

The control system of the present invention is incorporated into a headrail 34 which extends along the top of the architectural opening in which the covering is installed with the headrail securing the upper edge of the sheet material 24 in any suitable manner. The headrail is hollow to house the operative components of the control system and has at least some openings (not seen) through the bottom thereof through which the lift cords 30 can extend as well as the pull tape 46 for operating the system as will be described later.

The control system of the present invention includes a pull system component 38 which imparts uni-directional movement to a drive shaft 40 and to the aforementioned lift system component 32 which is operatively connected to the drive shaft whereby the pull system component 38 through the lift system component 32 moves the covering 22 between the lowered extended position and the raised retracted position. The lift system is adapted to cooperate with associated lift cords 30 which extend vertically along the sheet material 24 of the covering and are anchored to the bottom rail 26 as discussed previously. The lift system includes a unique roll up assembly designed to dependably wrap associated lift cords, during retraction of the covering, so that the lift cords do not become tangled when the covering is moved between extended and retracted positions.

PULL SYSTEM

Figure 17:
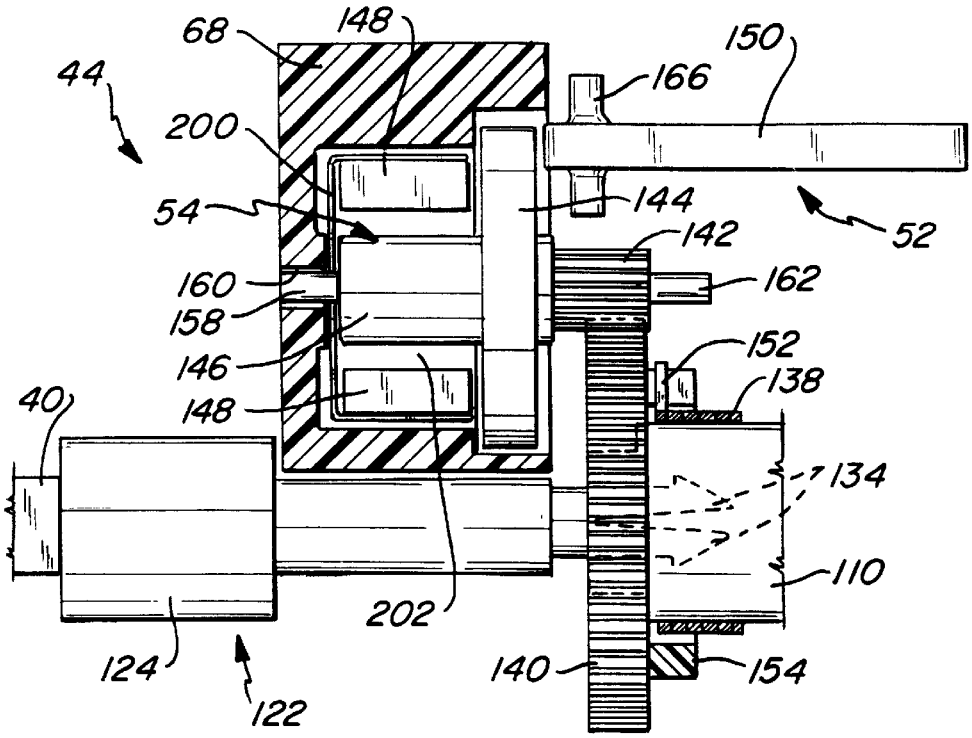
FIG. 17 is a vertical section taken through the clutch/brake assembly.

The pull system 38 which drives the lift system 32 includes two basic components, a main drive assembly 42 (FIG. 16), and a clutch/brake assembly 44 (FIG. 17). The main drive assembly 42 has the single pull tape 46 which is mounted on a rotatable drive spool 48 so as to be retractably wound on the spool. The drive spool 48 about which the pull tape is wound is automatically rotatably retracted when the pull tape is not being pulled so as to always preset or rewind the pull tape to a beginning position. The main drive assembly further includes a one-way clutch 50 operatively connected to the horizontal drive shaft 40. The drive shaft is operatively connected to the lift system 32 so that alternating extension and retraction of the pull tape causes the lift system to intermittently lift the shade from the extended to the retracted position.

Figure 6:
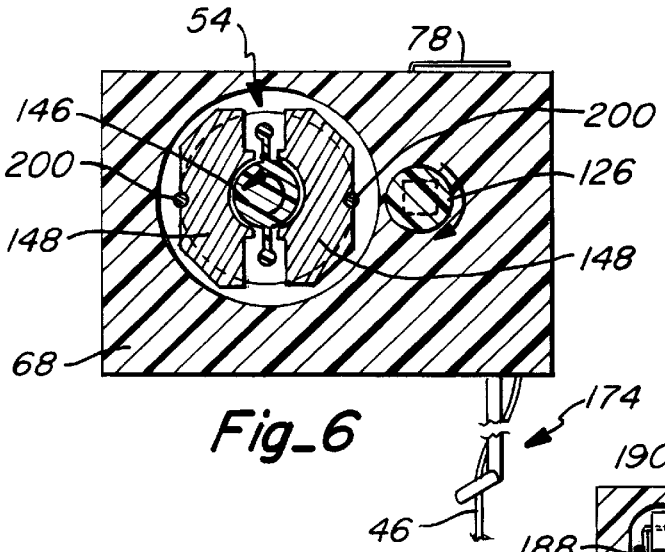
FIG. 6 is a reduced section taken along line 6—6 of FIG. 4.
Figure 7:
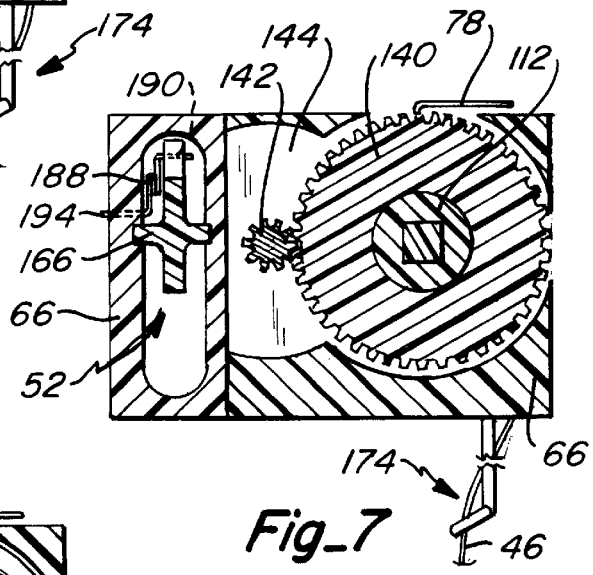
FIG. 7 is a reduced section taken along line 7—7 of FIG. 4.

The main drive assembly 42 is operatively connected to the clutch/brake assembly 44 which selectively prevents the drive shaft 40 from rotating in a second opposite direction which would allow the shade to be extended by gravity from its retracted to its extended position. The clutch/brake assembly has a brake mechanism 52 (FIGS. 7, 8, 11, 12 and 17) which is manually manipulatable between operative and inoperative positions with the brake in the operative position preventing rotation of the drive shaft 40 in the second direction and in the inoperative position allowing the drive shaft to freely rotate in the second direction such as when it is desired to lower the shade to the extended position. The clutch/brake assembly 44 further includes a centrifugal governor 54 (FIGS. 4 and 6) to regulate the speed at which the covering can drop by gravity from its retracted to extended position.

Figure 15B:
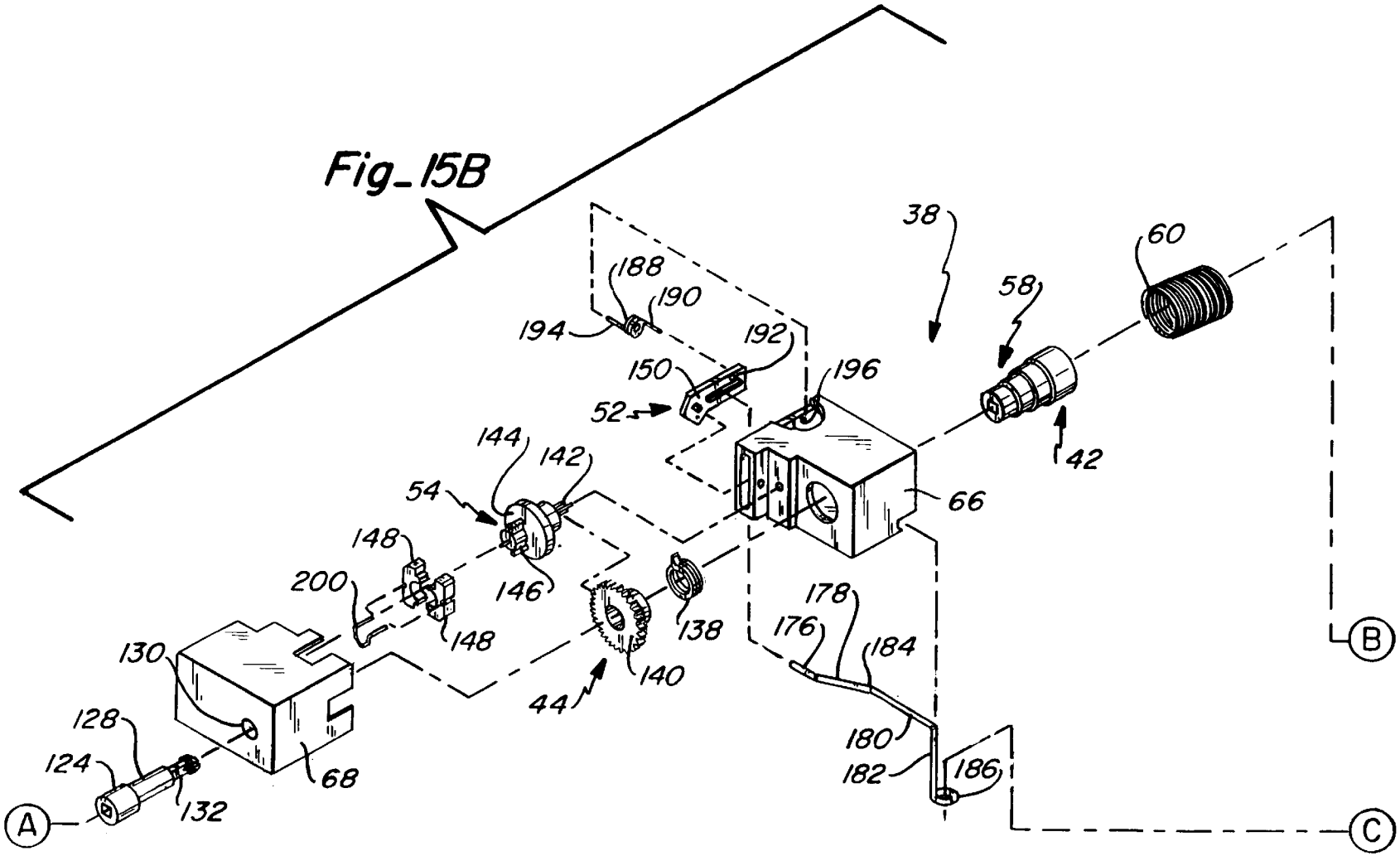
FIG. 15B is an exploded isometric of the clutch/brake assembly and a portion of the main drive assembly of the pull system component of the present invention.
Figure 15C:
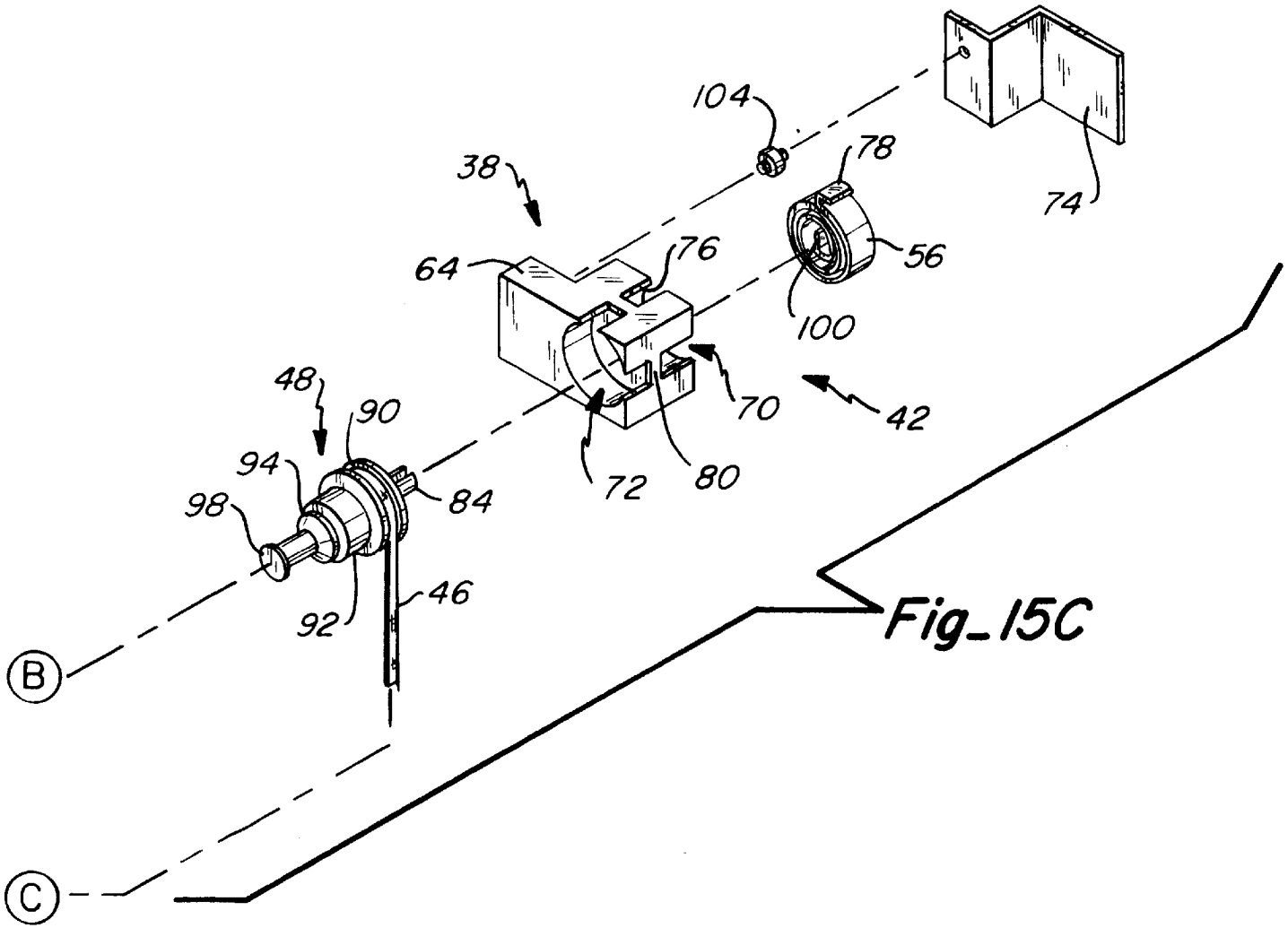
FIG. 15C is an exploded isometric of a portion of the main drive assembly of the pull system component of the present invention.
Figure 16:
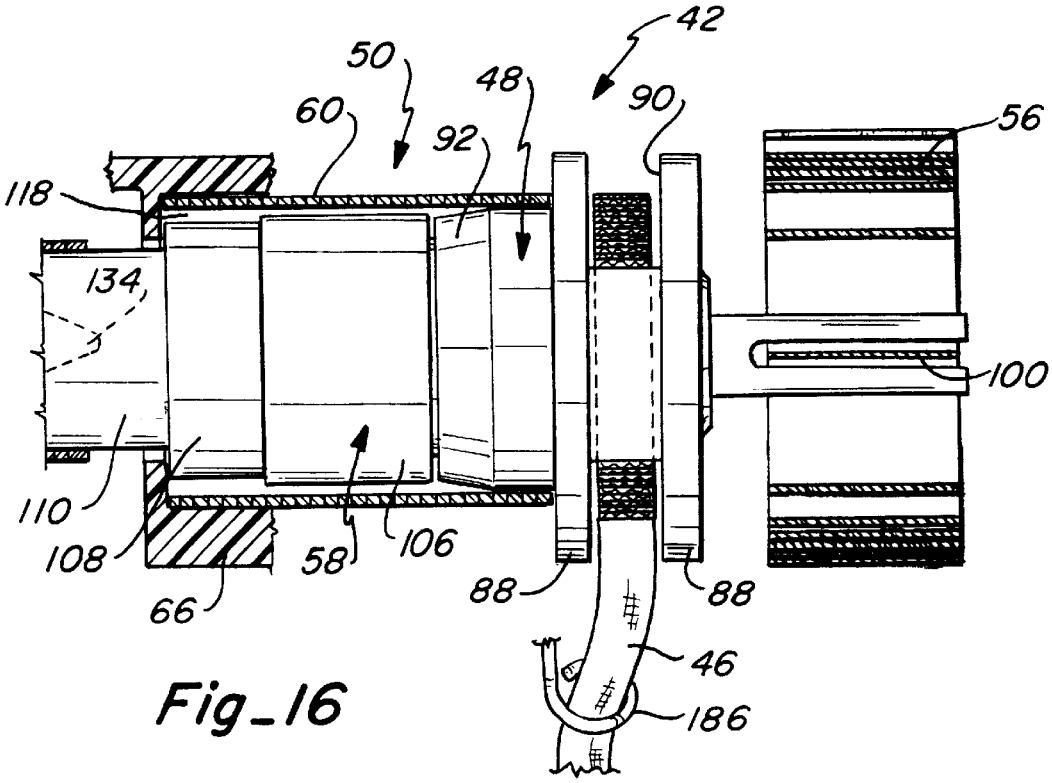
FIG. 16 is a vertical section taken through the main drive assembly.

The main drive assembly is probably best illustrated in FIGS. 15B, 15C, and 16 to include the main or tape drive spool 48, a return spring 56, a driven element or spool 58 to which the drive shaft 40 is operatively connected for unitary rotation, a clutch spring 60 and portions of a three-piece housing 62 for the pull system components. The housing pieces associated with the main drive assembly will be referred to as the right end portion 64 and the central portion 66 while a left end portion 68 of the housing is illustrated in FIG. 15B and will be described later in connection with the clutch/brake assembly 44. The three component portions of the housing, can be seen assembled in FIGS. 2 through 4.

The right end portion 64 of the housing 62 includes opposed axially aligned cylindrical recesses 70 and 72 which open in opposite directions, with the outermost recess 70 being adapted to receive the return spring 56 which is ultimately covered with an end cap 74 to confine the spring within the cylindrical recess. A rectangular opening 76 is provided through the top wall of the right end portion 64 which defines a shoulder adapted to confine one end 78 of the return spring 56 which, in the preferred embodiment, is a spiral spring. A divider wall 80 extends between the two cylindrical recesses 70 and 72 of the right end portion of the housing and has a relatively small circular aperture 82 (FIG. 4) therethrough coaxial with the recesses for a purpose to be described hereafter.

Figure 4:
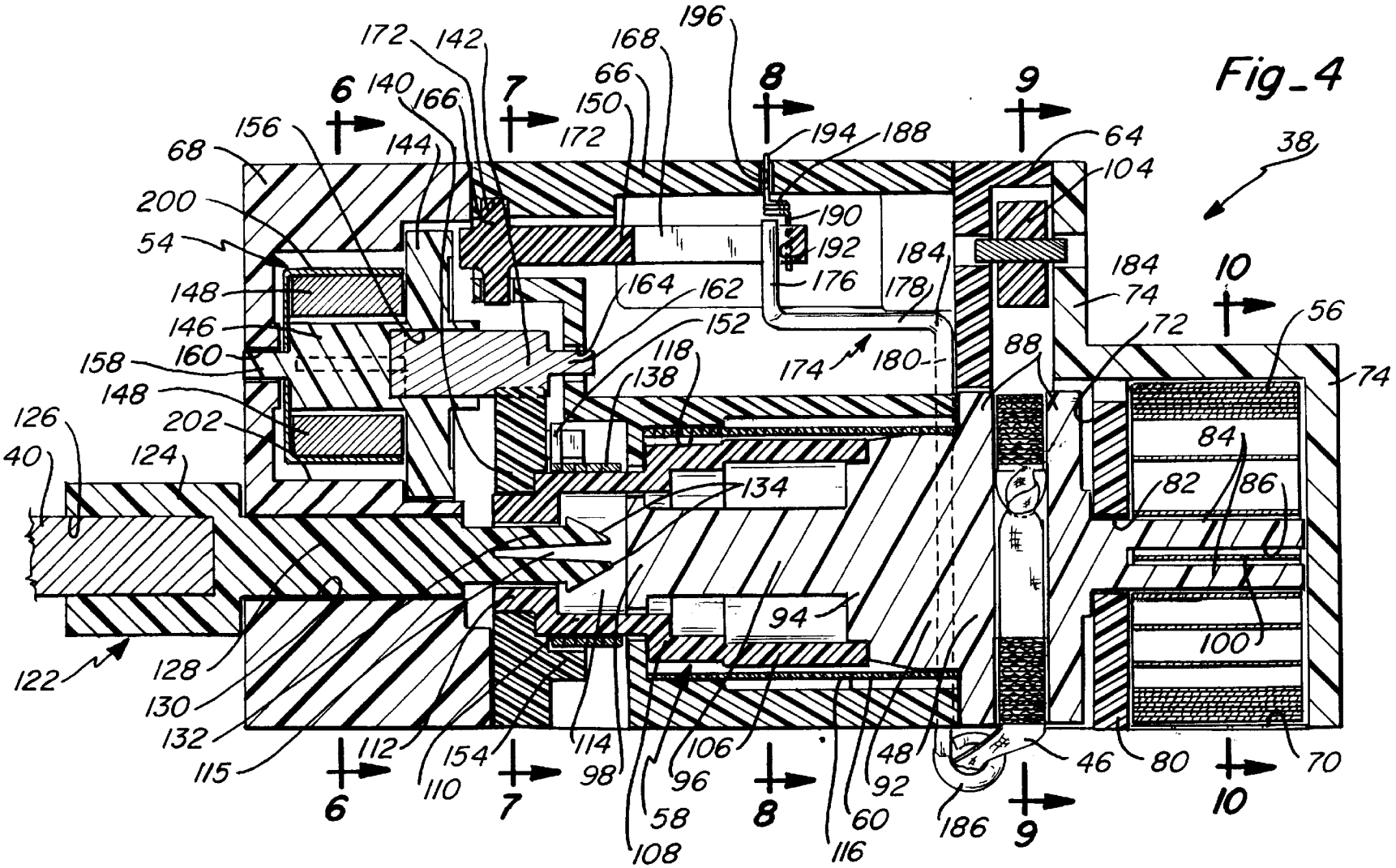
FIG. 4 is an enlarged section taken along line 4—4 of FIG. 3.

The tape drive spool 48, as best seen in FIGS. 4, 15C and 16, includes: a cylindrical support shaft 84 at one end having a longitudinal slit 86 therein; a pair of spaced integral cylindrical discs 88 defining a circular groove 90 therebetween; an integral large diameter body 92 that is somewhat frustoconical in configuration; an intermediate diameter body 94 extending axially from the large diameter body; and a cylindrical shaft 96 having an enlarged disc 98 on its distal end with all of the components of the drive spool being integral and in coaxial alignment. The support shaft 84 of the drive spool is adapted to ride in the aperture 82 through the divider wall 80 which serves as a bearing surface and the spiral spring 56 is adapted to be positioned on the support shaft 84 with the opposite end 100 of the spiral spring anchored in the slit 86 in the shaft.

Figure 9:
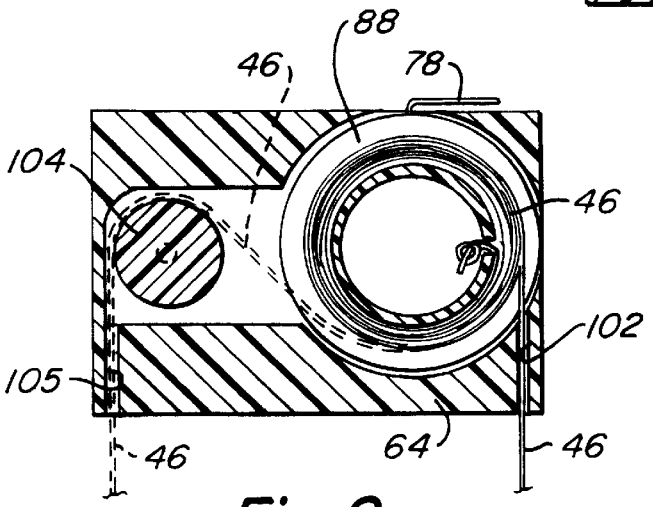
FIG. 9 is a reduced section taken along line 9—9 of FIG. 4.
Figure 10:
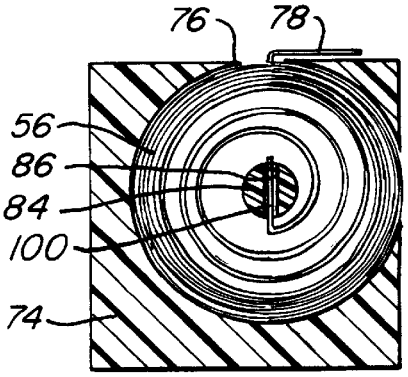
FIG. 10 is a reduced section taken along line 10—10 of FIG. 4.
Figure 8:
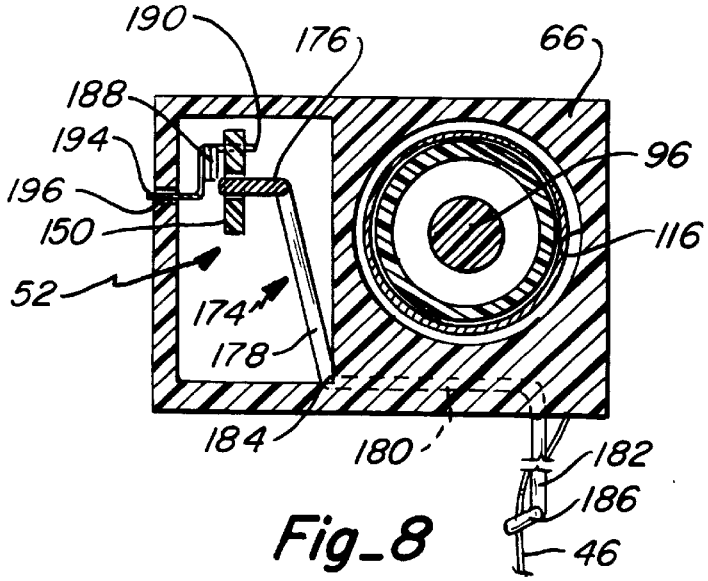
FIG. 8 is a reduced section taken along line 8—8 of FIG. 4.

The circular groove 90 between the spaced discs 88 defines a channel in which the pull tape 46 can be wound and unwound with one end of the pull tape anchored within the circular groove in any convenient manner. The tape extends through a passageway 102 (FIG. 9) in the right housing portion 64 for access to an operator with the passageway 102 being substantially tangential to the circular groove 90. The above arrangement presumes the pull system 38 is mounted at the right end of the covering so the pull tape would hang from the front of the housing 62. If the pull system were to be mounted at the left end of the covering, the tape 46 would extend, as shown in dashed lines in FIG. 9, not through the passageway 102 but internally around a pulley 104 and subsequently through an alternate passageway 105 that is tangential to the pulley so that the tape would again be on the front of the housing 62 for easy access to an operator.

The large diameter body 92 of the drive spool that is somewhat frusto-conical serves to releasably seat one end of the clutch spring 60 while the intermediate diameter body 94 of the drive spool rotatably receives and seats one end of the driven element 58.

The driven element 58, as probably best seen in FIGS. 4 and 15B, is a hollow generally cylindrical element having four discreet diameter segments 106, 108, 110 and 112 of reduced size as the driven element extends away from the drive spool. The largest diameter segment 106 of the driven element is the segment which is rotatably seated on the intermediate diameter body 94 of the drive spool. The interior of the driven element 58 has a plurality of cylindrical cavities, corresponding to the discreet diameter segments, of correspondingly diminishing diameter and in combination establish the complete hollow interior of the driven element. The second to the smallest diameter cavity 114 serves to rotatably support the disc 98 on the end of the shaft 96 of the drive spool and the smallest cavity 115 within the segment 112 is of square cross-section for a purpose to be described later. Accordingly, the driven element is rotatably supported at one end on the drive spool for rotation about a common axis with the drive spool but not necessarily in unison with the drive spool.

As best seen in FIGS. 4 and 16, the central housing portion has a cylindrical cavity 116 that receives the segment 106 of the driven element 58 as well as the large diameter body 92 of the drive spool. The cylindrical cavity 116 is of a relatively large diameter so as to be circumferentially spaced from the segment 106 of the driven element and opens toward the right end portion of the housing. The cavity 116 communicates with a coaxial relatively small diameter cavity 118 which is circumfercntially spaced from the segment 108 of the driven element. The small diameter cavity is adapted to cooperate with the clutch spring 60 in a manner to be described hereafter in order to selectively impart uni-directional rotational movement from the drive spool 48 to the driven element 58.

The clutch spring 60 is a coil spring which in its relaxed state has an internal diameter slightly less than the largest diameter of the frustoconical surface 92 of the drive spool 48 but slightly greater than the largest diameter segment 106 of the driven element 58. The outer diameter of the clutch spring in its relaxed state is slightly greater than the diameter of the small diameter cavity 118 in the central portion 66 of the housing. As will be appreciated, when the clutch spring is in its relaxed state as illustrated in FIGS. 4 and 16, the spring is in internal frictional gripping relationship with the drive spool 48 at its right end and externally with the cylindrical cavity 118 at the left end. It is circumferentially spaced, however, from the driven element 58. Rotational movement of the drive spool 48 in the first direction will cause the clutch spring 60 to grip the driven element 58 causing unitary rotation of the driven element with the drive spool, whereas rotational movement of the drive spool in the opposite or second direction will allow the driven element to be freely rotatable relative to the drive spool. When the clutch spring 60 is contracting, radially inwardly, as when the drive spool is rotated in the first direction, the taper of the frustoconical surface 92 on the drive spool allows the coil spring to be reduced enough in diameter to frictionally grip the segment 106 of the driven element as best appreciated in FIGS. 4 and 16.

Figure 5:
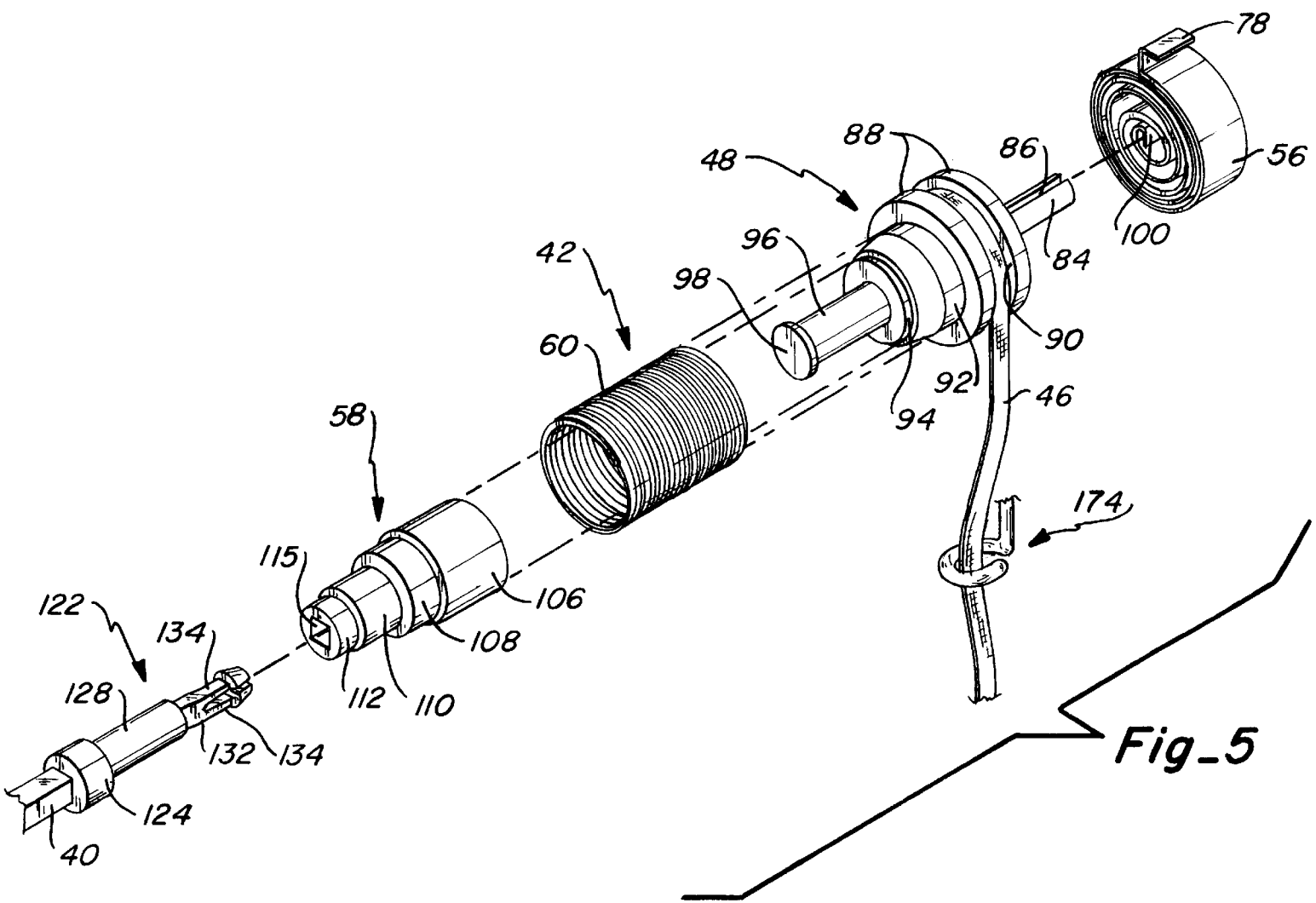
FIG. 5 is an enlarged and exploded isometric illustrating the main drive assembly of the control system of the present invention.

As will be appreciated from the afore noted description of the components of the main drive assembly 42 and with particular reference to FIGS. 4, 5 and 16, the drive spool 48 is connected to the return spiral spring 56 which is in turn anchored to the right end portion 64 of the housing in a manner such that rotation of the drive spool in a first direction (clockwise as viewed in FIG. 5), which is caused upon an unwinding of the pull tape 46 from the drive spool, will cause the spiral spring to contract while yieldingly resisting rotational movement of the drive spool in the first direction. Once the pull tape has been unwound a predetermined amount, the return spring, which is continually biasing the drive spool in the opposite or second direction (counter-clockwise as viewed in FIG. 8), will counter-rotate the drive spool until the tape has been rewound thereon a predetermined amount. Further, when the pull tape is being unwound from the drive spool, the drive spool through the one-way clutch 50 is operatively connected to the driven element 58 so that the drive spool 48 and driven element 58 rotate in unison in a direction which causes the lift system 32 to raise the shade or covering from the lowered extended position to the raised retracted position as will be described in more detail hereafter.

The smallest diameter segment 112 of the driven element 58 has the small cavity 115 which is square in cross-section and which is adapted to operatively receive one end of the drive shaft 40 which extends across the top of the architectural opening within the confines of the headrail 34. At the end of the drive shaft that is connected to the driven element (FIG. 4), an axially extending cylindrical cap 122 is provided that is fixed to the drive shaft for unitary rotation therewith. The cap 122 has a cylindrical main body 124 with a recess 126 of square cross-section adapted to matingly receive the end of the drive shaft 40, which is also of square cross-section, and a reduced diameter cylindrical shaft portion 128 adapted to rotate within a passageway 130 in the left end portion 68 of the housing. A bifurcated axial extension 132 from the shaft portion 128 of the end cap is of square cross-section and defines two arms 134 that are flexible relative to each other with tapered heads so that the bifurcated extension can be advanced through the square cavity 115 in the driven element 58 and be releasably connected thereto in a manner such that the cap 122 on the drive shaft 40 will rotate in unison with the driven element 58 and with the drive shaft.

It will be appreciated from the description thus far that the main drive assembly 42 is designed to uni-directionally rotate the drive shaft 40 in a first direction when the pull tape 46 is being unwound from the drive spool 48 but will allow the drive shaft to rotate freely in either direction as the pull tape is being rewound onto the drive spool. The main drive assembly, therefore, imparts an intermittent uni-directional drive to the drive shaft but, as will be appreciated, when the pull tape is being rewound onto the drive spool and the drive shaft is operatively free of the drive spool, the shade or covering will drop by gravity unless otherwise prevented.

As mentioned previously, the control system 20 of the present invention is designed to incrementally raise the shade from the lowered extended position to a raised retracted position with repeated unwinding strokes of the pull tape. The pull tape is repeatedly unwound and rewound onto the drive spool until the shade has been incrementally raised to the desired height, which may be a fully retracted position adjacent the headrail.

While a pull tape system has been disclosed for imparting rotational movement to the drive spool, it will be apparent to those skilled in the art that a cord could replace the tape or a handle connected to the drive spool could be reciprocated about the axis of the spool thereby reciprocating the drive spool about its axis. The increments of driving motion for lifting the shade with a handle would be smaller than with tape or cord but the same incremental drive would be obtained.

The clutch/brake assembly 44, which is probably best seen in FIGS. 4, 11, 12, 15B and 17, maintains control of the drive shaft 40 when it is not being rotatably driven in the first direction by the main drive assembly 42. The clutch/brake assembly is designed to always permit rotation of the drive shaft in the first direction but selectively permit rotation in the opposite or second direction. This allows the shade to be incrementally raised by the main drive assembly but selectively prevented from dropping as would be caused by rotation of the drive shaft in the second opposite direction. The prevention is achieved when the brake mechanism 52 is in an operative position (FIG. 12) but when the brake is in an inoperative position (FIG. 11), the drive shaft is permitted to rotate freely in the second or opposite direction. In the inoperative position, the drive shaft is thereby permitted to rotate freely which occurs in the second direction as gravity moves the shade or covering toward the extended position thereby rotating the drive shaft in the second direction. The brake/clutch assembly, as will be described in more detail hereafter, further includes the governor 54 which controls the speed at which the covering can move from the retracted to the extended position as when the drive shaft is rotating in the second direction.

Figure 11:
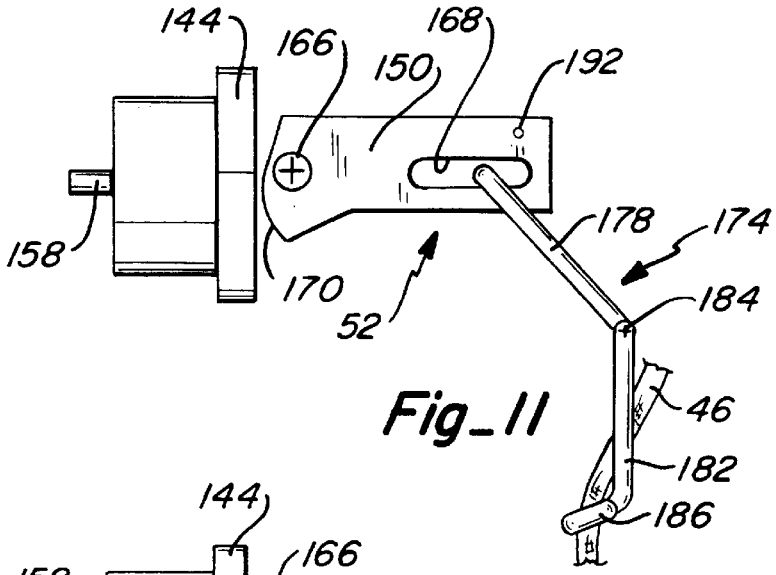
FIG. 11 is an operational view of the brake portion of the clutch/brake assembly with the brake in an inoperative position.
Figure 12:
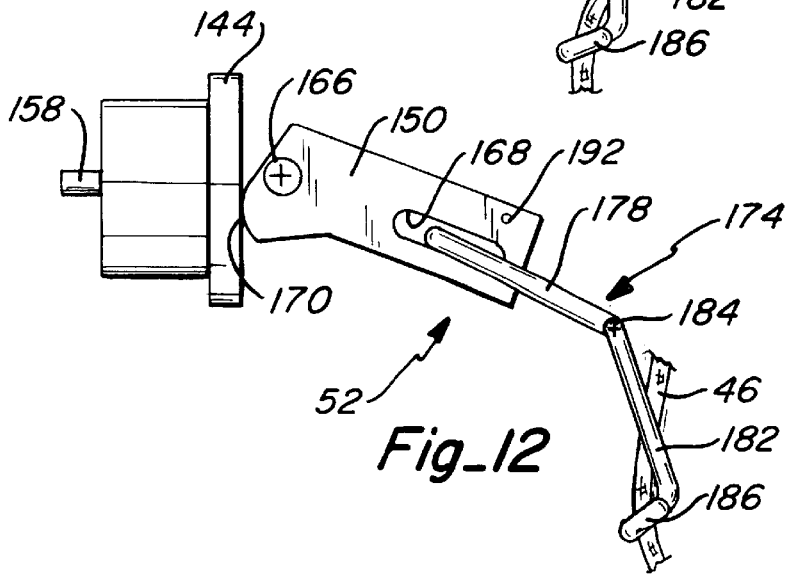
FIG. 12 is an operational view similar to FIG. 11 with the brake in an operative position.

The clutch/brake assembly 44, as probably best seen in FIG. 17, includes a second clutch spring 138 operatively connected to a ring gear 140 which is intermeshed with a pinion gear 142 forming an axial extension from a brake disc 144. The brake disc has an integral governor hub 146 that cooperates with centrifugal weights 148 in controlling the speed of rotation of the brake disc. A brake arm 150, as seen not only in FIG. 17 but also in the operational views of FIGS. 11 and 12, is selectively movable between operative (FIG. 12) and inoperative (FIG. 11) positions to prevent or permit, respectively, rotation of the brake disc. The ring gear 140 is rotatably mounted on the smallest diameter portion 112 of the driven element 58 and is positioned immediately adjacent to the second clutch spring 138. The second clutch spring is a coil spring positioned on the driven member with the second clutch spring having a raised tang 152 positioned within a slot of an extension ring 154 of the ring gear. The tang provides an operative connection between the second clutch spring and the ring gear so that the two elements substantially move rotatably in unison with each other. The second clutch spring 138 is wound in a direction and has an internal diameter relative to the diameter of the driven element 58 on which it is mounted such that rotational movement of the driven member in the first direction, which causes the shade to be raised toward its retracted position, has the effect of radially enlarging the diameter of the second clutch spring so that the driven element is free to rotate in that direction within and relative to the second clutch spring. However, rotative movement of the driven element in the opposite direction which is caused when the shade is being lowered causes, through frictional engagement, the second clutch spring to be radially reduced in diameter thereby frictionally connecting the driven element to the second clutch spring and consequently the ring gear 140 for unitary movement of the three component parts. Accordingly, if the ring gear is permitted to rotate in this second direction, then so will the driven element 58 and the drive shaft 40 which allows the shade to be lowered. On the other hand, if the ring gear is prohibited from rotating in the second direction such as by application of the brake mechanism 52, then the drive shaft for the same reasons will be prohibited from rotating in the second direction.

As mentioned previously, the ring gear 140 is intermeshed with the pinion gear 142 that is coaxially connected to the brake disc 144 for unitary rotation therewith. The brake disc has an axial cavity 156 adapted to receive and be keyed or otherwise connected to the pinion gear as best seen in FIG. 4 for unitary rotation therewith. The brake disc further has a small diameter support shaft 158 rotatably seated in an opening 160 in the left end portion 68 of the housing and this support shaft cooperates with a support shaft 162 on the end of the pinion gear which is rotatably seated in an opening 164 in the central portion 66 of the housing so that the brake disc and pinion gear are disposed for unitary rotation about their common longitudinal axis.

As mentioned previously, the brake arm 150 is adapted to selectively prevent or permit rotation of the brake disc 144 which consequently prevents or permits rotation of the ring gear 140 and the driven element 58 in the second or opposite direction. The operation of the brake arm is probably best illustrated in FIGS. 4, 11 and 12. The brake arm is an elongated bar having a support shaft 166 extending transversely in opposite directions from one end, an elongated slot 168 provided in the opposite end and a rounded head 170 adjacent the support shaft 166. The support shaft is rotatably seated in recesses 172 within the central portion 66 of the housing as seen in FIG. 4 allowing the brake arm to pivot about the shaft. The rounded head 170 of the brake arm is positioned immediately adjacent to the brake disc so that in the inoperative position (FIG. 11), the brake arm is spaced from the brake disc and the disc is free to rotate relative to the brake arm, but in the operative position (FIG. 12), the brake arm is pivoted slightly in a clockwise direction so that the rounded head of the brake arm engages the face of the brake disc and frictionally prohibits rotation of the brake disc. The design of the rounded head 170, the placement of the support shaft 166 and the relationship to the brake disc 144 are such that the more the brake disc wants to turn in a given direction, the more pressure applied by the brake arm to prevent the rotation. The given direction of rotation corresponds with rotation of the driven element 58 in the second direction which is the direction that allows the shade to lower.

The pivotal movement of the brake arm is caused by a brake activator 174 (FIGS. 4, 8, 11, and 12) which is in the form of an elongated link having five integral sections that extend through various areas of the housing 62 so that the brake activator is pivotally mounted within the housing and protrudes from the bottom of the housing. The first section 176 consists of an arm that slidably protrudes transversely through the elongated slot 168 in the brake arm and in a position to pivot the brake arm about the support shaft 166. The second, third, and fourth sections 178, 180 and 182 respectively are straight and angularly related so as to extend through the housing such that the fourth section 182 protrudes downwardly from the central portion 66 of the housing. The activator arm is pivotally mounted in the housing at the elbow 184 between the second and third sections. The fifth section 186 of the brake activator is simply a loop formed in the activator at an angle relative to the fourth section and the loop slidably receives the pull tape 46 such that when the pull tape is extended substantially straight down, as when the pull tape is being wound and unwound from the tape spool 48, the activator arm assumes the operative or braking position (FIG. 12), whereas when the pull tape is pulled laterally to the left, as in FIG. 11, the activator arm is pivoted about elbow 184 in a clockwise direction into the inoperative position. Movement of the activator arm from the operative position of FIG. 12 to the inoperative position of FIG. 11 causes the brake arm 150 to pivot counter-clockwise thereby providing a system whereby through a simple manual manipulation of the pull tape 46, the brake mechanism 52 can be rendered operative or inoperative as desired.

As seen in FIGS. 4 and 15B, a small coil spring 188 has one tang 190 protruding into a hole 192 in the slotted end of the brake arm 150 with its opposite tang 194 protruding into a hole 196 in the central housing portion 66. The spring 188 serves to bias the brake arm toward the operative position of FIG. 12. In other words, when the pull tape 46 is moved to the left, as viewed in FIG. 11, to render the brake inoperative, it is only a temporary move against the bias of the spring 188 and when the pull tape is allowed to extend substantially straight downwardly, the brake arm will immediately and automatically return under the bias of the spring to the operative or braking position of FIG. 12.

As will be appreciated from the above, when the brake arm 150 is in its normal operative or braking position and in engagement with the brake disc 144 to prevent rotation of the disc, the pinion gear 142 and ring gear 140 are also prevented from rotating. As explained previously, the second clutch spring 138 which is operatively connected to the ring gear prevents the driven element 58 and consequently the drive shaft 40 from rotating in the second direction which would otherwise allow the shade to be lowered. Consequently, when the tape spool 48 is being rotated in the first direction as when the tape 46 is being unwound therefrom during a pulling motion applied to the tape, the drive spool will impart rotative motion to the driven element which is accomplished through the first clutch spring thereby rotating the drive shaft in the first direction and causing the shade to be lifted as the drive spool is rotated. When a pulling motion on the pull tape is terminated and the pull tape is rewound on the drive spool through the action of the spiral return spring 56, the second clutch spring grips the driven element and normally prevents rotation thereof through the brake arm, brake disc, pinion gear, and ring gear so that the shaft will not rotate in the opposite direction which would otherwise be caused through gravity acting upon the weight of the shade which biases the shade toward the extended position. However, if it is desired to allow the shade to be lowered, it is simply a matter of releasing the brake arm from engagement with the brake disc by moving the pull tape laterally to the left, as shown in FIG. 11. This permits the brake disc, pinion gear, and ring gear to rotate which, in turn, permits the driven member through the second spring clutch and the drive shaft to rotate in the second direction which allows the shade to lower by gravity.

Depending upon the weight of the shade, when the brake mechanism 52 is released thereby allowing the shade to be moved by gravity from a raised retracted position to a lowered extended position, the shade might drop too rapidly. To prevent such an occurrence, the governor 54 mentioned previously is operatively associated with the brake disc 144. The governor, as probably best seen in FIGS. 4, 15B and 17, could take various forms such as a viscous fluid or the like but in the disclosed embodiment consists of the pair of spaced weights 148, mentioned previously, pinned together with a generally U-shaped clip 200 for pivotal movement about the legs of the clip and within the confines of a cavity 202 in the left housing portion which is coaxial with the opening 160 that rotatably supports the support shaft 158 of the brake disc. The weights are circumferentially distributed about the enlarged hub 146 of the support shaft 158 to control and confine their movement. The governor is a centrifugal governor which operates by rotation of the brake disc and, particularly, its shaft 158 so that the weights which are pinned to the shaft with the U-shaped clip will rotate with the shaft and be centrifugally forced radially outwardly in a pivotal motion about the legs of the U-shaped clip until the weights engage the internal cylindrical wall of the cavity 202. Engagement of the weights with the wall of the cavity provides frictional drag which inhibits the speed at which the brake disc, and consequently the drive shaft, are permitted to rotate. In this manner, when the drive shaft is released by the brake arm 150 to allow the shade to lower, it will only drop at a predetermined and governed rate.

LIFT SYSTEM

As mentioned previously, the lift system 32 which is best seen in FIGS. 1, 2, 3 and 15A, is driven by the afore described pull system 38 through the drive shaft 40 which extends horizontally across the covering within the headrail 34. In reality, there would be a plurality of lift systems positioned across the width of the covering at locations where a lift cord is deemed appropriate for uniformly lifting the covering across its entire width. In other words, on relatively narrow coverings, only two lift systems may be necessary whereas on relatively wide coverings, three or more lift systems may be appropriate, all of which would be driven by the same drive shaft.

Figures 13, 14, 15A:
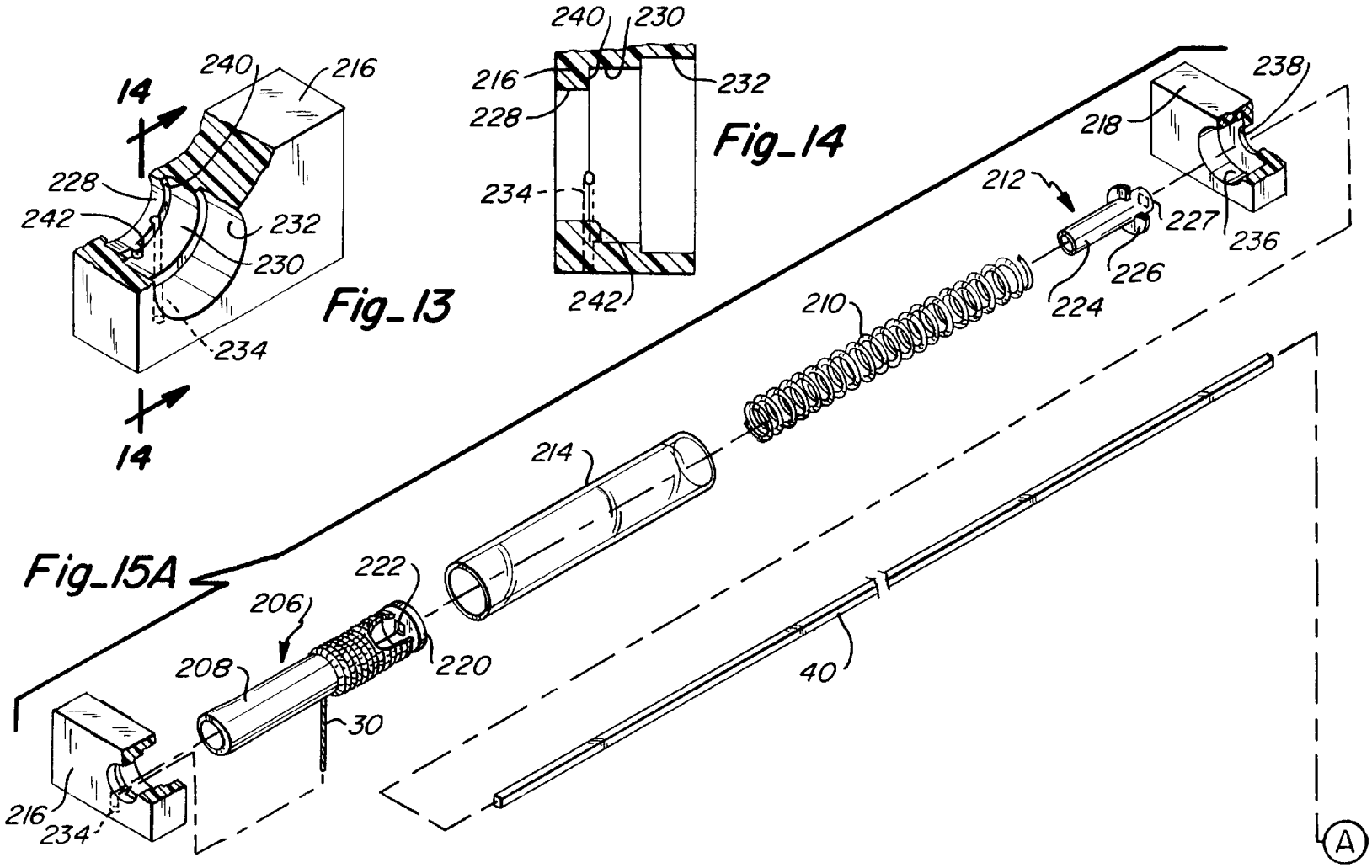
FIG. 13 is an isometric view with parts broken away illustrating a portion of the housing for the lift system wherein the lift cord can be introduced to the cord spool.
FIG. 14 is an enlarged section taken along line 14—14 of FIG. 13.
FIG. 15A is an exploded isometric of the lift system component of the control system of the invention.

The lift system 32, as best seen in FIG. 15A, includes an elongated cylindrical cord spool 206 with a cylindrical body 208, a resilient member disclosed as a compression spring 210 axially aligned with the cord spool, a spring support spool 212, a cylindrical shell 214 encompassing the cord spool compression spring and spring support spool, and left and right end support brackets 216 and 218 respectively for operatively supporting the other lift system components. The cord spool consists of an elongated hollow cylinder having an enlarged disc-shaped end 220 at the right end as viewed in FIG. 15A. The disc-shaped end has a square axial opening 222 therethrough designed to slidably but matingly receive the drive shaft 40 which is adapted to extend completely through the lift system in rotative driving engagement with the cord spool. The disc-shaped end 220 has a radius that is greater than the radius of the cylindrical body 208 by a dimension slightly greater than the width of the lift cord 30 but less than twice the width of the lift cord. The radius of the disc-shaped end is also substantially the same as the internal radius of the cylindrical shell 214 and similar to the outer diameter of the compression spring 210 which is slidably disposed within the cylindrical shell.

The spring support spool 212 has a shaft portion 224 substantially equal in diameter to the inner diameter of the compression spring 210, a circumferential projection 226 at a location spaced slightly inwardly from the right end of the spool and a short support shaft 227 extending to the right from the circumferential projection. The spring support spool has a square passage therethrough which matingly and slidably receives the drive shaft.

When assembled, the cord spool 206 is rotatably and slidably positioned within the cylindrical shell 214. The compression spring 210 is further disposed within the cylindrical shell and is in abutting relationship with the disc-shaped end 220 of the cord spool to bias the cord spool to the left as viewed in FIG. 15A. The right-hand end of the compression spring is supported on the spring support spool 212 and as mentioned previously, the drive shaft 40 extends completely through the assembled components and in driving relationship with the spring support spool and the cord spool so that the spools rotate in unison with the drive shaft and through frictional engagement with the spools, the compression spring also rotates with the drive shaft. While not specifically disclosed, it would be apparent to those skilled in the art that the compression spring could be replaced with other resilient material such as a compressible foam collar or the like.

The support brackets 216 and 218 are provided at opposite ends of the lift system with the bracket 216 at the left end as viewed in FIG. 15A serving to rotatably support the cylindrical body of the cord spool 206. As best seen in FIGS. 13 and 14, the bracket 216 has three coaxially aligned cylindrical recesses 228, 230 and 232 with the smaller diameter recess 228 being at the left side of the bracket and the largest diameter recess 232 being at the right side of the bracket. An elongated vertical cord passage 234 extends through the bracket from the bottom of the bracket so as to be substantially tangentially communicating with the smaller diameter recess 228. The smaller diameter recess serves to rotatably and slidably support the cylindrical body 208 of the cord spool and the larger diameter recess 232 positively and frictionally seats the left end of the cylindrical shell 214. The inner diameter of the cylindrical shell substantially corresponds with the diameter of the intermediate sized recess 230 so that a circumferential gap is provided between the outer surface of the cylindrical body of the cord spool and the inner wall of the intermediate sized recess 230 as well as the inner surface of the cylindrical shell 214. This circumferential gap is slightly greater than the diameter or width of the lift cord 30, but less than twice the diameter of the lift cord, so that the lift cord can be wrapped around the cylindrical body of the cord spool within the left bracket 216 and the cylindrical shell 214 in a manner to be described hereafter.

The bracket 218 at the right end of the lift system has a passage therethrough defining two coaxial cylindrical cavities 236 and 238 with the larger of the cavities 236 being on the left side of the bracket and adapted to receive and seat the right end of the cylindrical shell 214 and the circumferential projection 226 on the spring support spool 212. The smaller cavity 238 opening through the right side of the bracket is sized to receive and support the support shaft 227 of the spring support spool which extends to the right beyond the circumferential projection.

Figure 2:
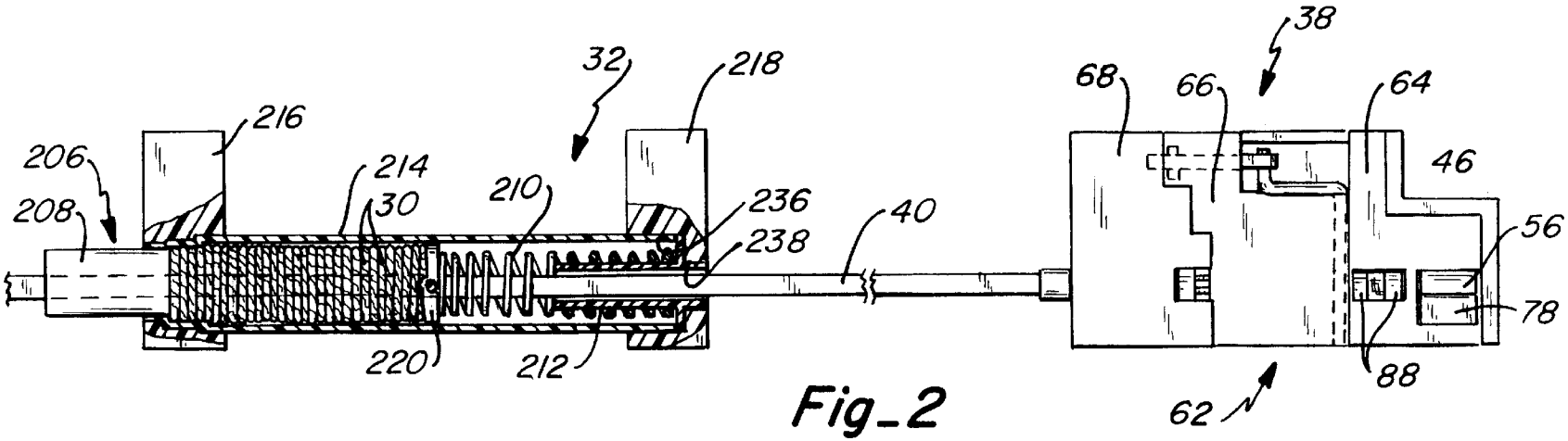
FIG. 2 is an enlarged top plan that is partially sectioned looking along line 2—2 of FIG. 1.
Figure 3:
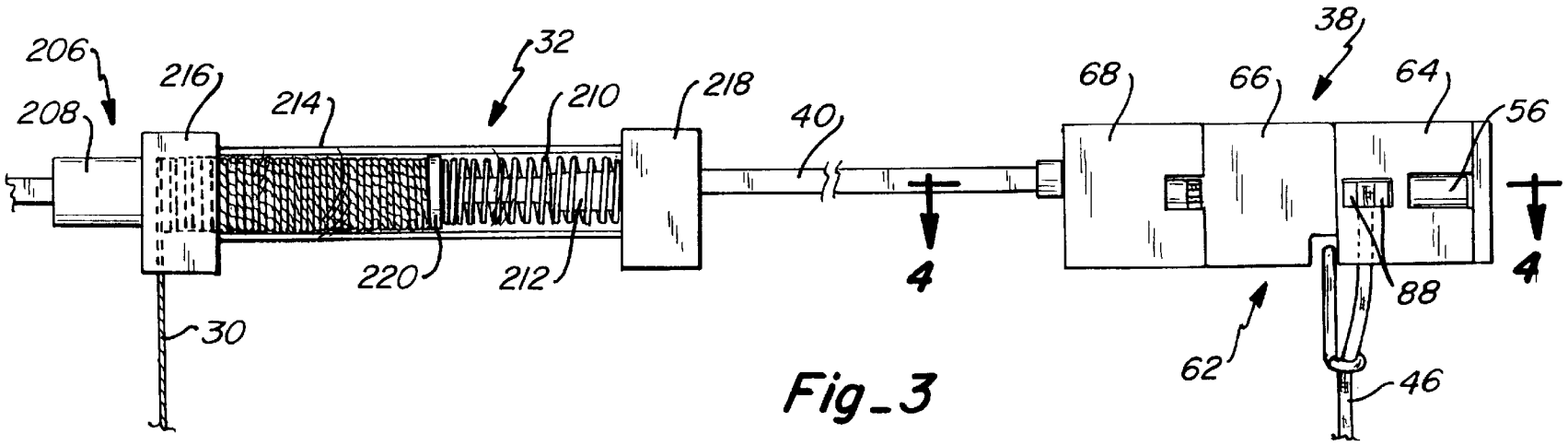
FIG. 3 is an enlarged side elevation as viewed along line 3—3 of FIG. 1.
Figure 3A:
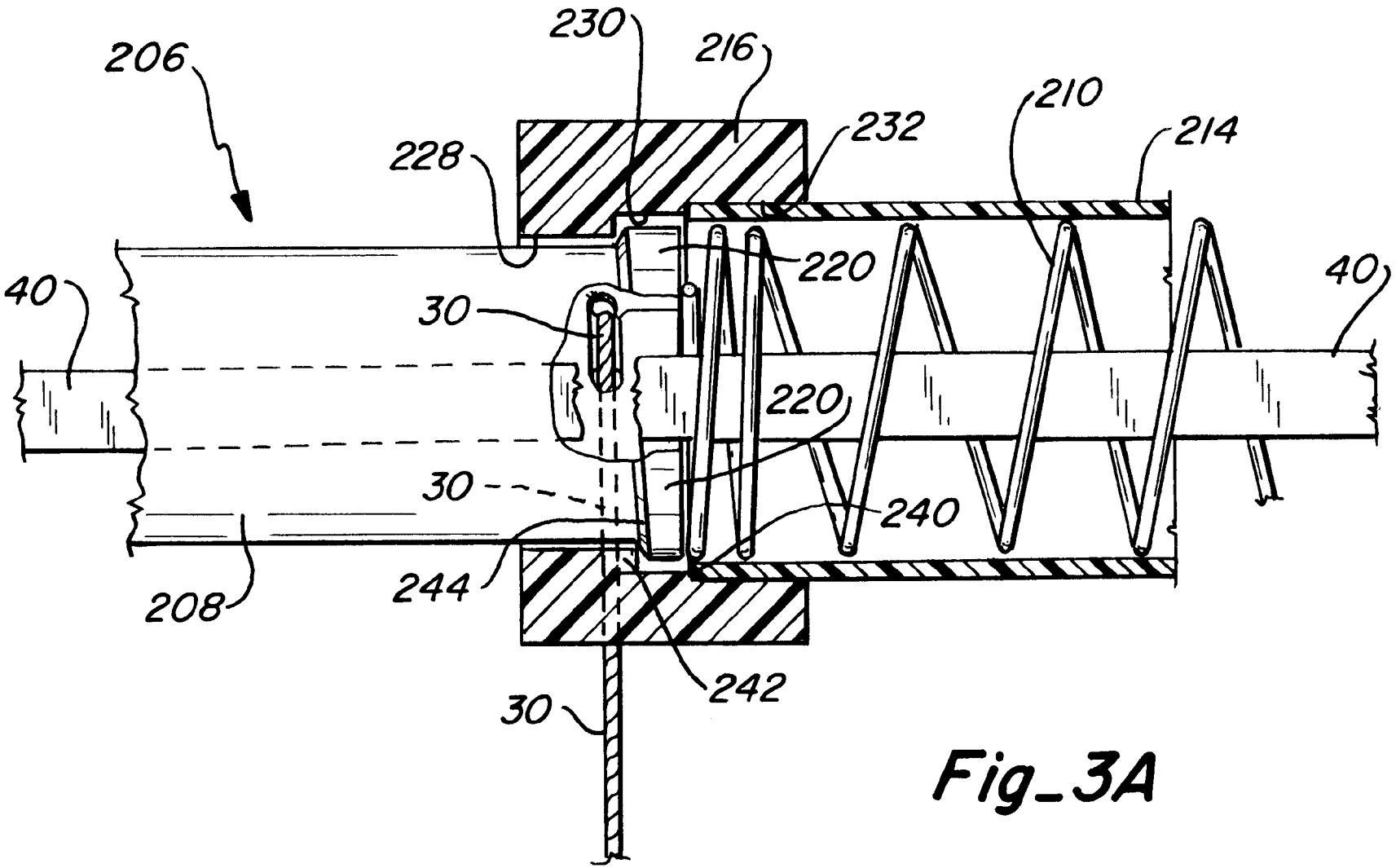
FIG. 3A is an enlarged fragmentary section taken through the left end bracket of the lift system.

As probably best illustrated in FIGS. 2 and 3, when the lift system 32 is assembled, the left bracket 216 slidably and rotatably supports the cord spool 206 and also supports the left end of the cylindrical shell 214 while the right bracket 218 provides a support for the right end of the cylindrical shell and the spring support spool 212. The spring support spool, of course, receives and supports the right end of the compression spring 210 while the left end of the compression spring is engaged with the disc-shaped end 220 of the cord spool. The compression spring thereby yieldingly resists sliding movement of the cord spool to the right as viewed in FIGS. 2 and 3 and biases the cord spool to the left. The compression spring 210 is a light spring but is strong enough to push the cord spool completely to the left when there are no counter forces. The disc on the right end of the spool engages the shoulder 240 between the small and intermediate sized cavities 228 and 230 in the left bracket which defines the extreme left position of sliding movement of the cord spool as shown in FIG. 3A.

The lift cord 30 itself, after having been attached to the bottom rail 26 of the covering as mentioned previously is extended upwardly either through the set of aligned holes 28 in the pleats of the covering sheet or adjacent to the covering sheet, is fed through the cord passage 234 in the left bracket 216 and thereafter anchored in any conventional manner to the disc-shaped end 220 of the cord spool within the circumferential gap defined between the cord spool and the cylindrical shell. It will be appreciated when the cord spool is in its neutral position of FIG. 3A at the extreme left, with the disc-shaped end of the cord spool engaging the shoulder 240, there is only a very short length of cord within the gap. This is the position assumed by the cord spool when the covering is fully extended across the architectural opening. A small bead 242 (FIGS. 3A, 13 and 14), is provided in the shoulder 240 at a short distance from the inner end of the cord passage 234 so that when the cord extends through the passage and is anchored to the disc-shaped end of the cord spool, rotation of the cord spool in a counterclockwise direction as viewed in FIG. 15A will cause the cord to engage the bead 242 and thereby be deflected to assume an acute angle relative to the length of the cord spool. Continued counterclockwise rotation of the cord spool will cause the cord to be wrapped at an angle or diagonally around the spool with each successive wrap engaging a previous wrap and thereby pushing the cord spool to the right as viewed in FIG. 15A against the bias of the compression spring. For that reason, it will be appreciated that the compression spring cannot be a strong spring as its spring bias must be overcome by the small amount of pressure that is applied by each wrap of cord engaging a previous wrap.

The cord being fed to the cord spool 206 through the cord passage 234, of course, is fed tangentially to the cord spool which avoids any binding and allows the cord to be fed smoothly onto the cord spool. Further, the dimension of the gap between the cord spool and the cylindrical shell being only slightly greater than the thickness of the cord prevents the cord from overlapping or double wrapping so that a single layer of cord is reliably diagonally wound on the cord spool as it is rotated in a counterclockwise direction.

The length of the cord spool 206 is predetermined to accommodate the amount of cord 30 necessary for a full extension of the covering and as will be appreciated, the length of the cylinder can be varied due to the fact that the free left end of the cord spool can extend through the left bracket 216 to any necessary degree. To also encourage a diagonal wrap of the cord on the spool which encourages the cord spool to be urged against the bias of the compression spring, the inner surface of the disc-shaped end 220 of the cord spool 206 may be beveled slightly at 244 in the desired direction of the diagonal wrap. The beveled surface would complement the relationship of the bead 242 with the cord passage 234 to assure a diagonal wrap.

Of course, the counterclockwise rotation of the cord spool corresponds with the direction in which the drive shaft 40 is rotated when the pull tape 46 is unwound from the tape drive spool 48 in the main drive assembly 42 causing the covering to be lifted. As mentioned, depending upon the length of the shade, this counterclockwise rotating movement occurs intermittently as the pull tape is alternately unwound and wound. When it is desired to lower the shade and the brake arm 150 is moved into its inoperative position, the drive shaft will be allowed to rotate clockwise as viewed in FIG. 15A thereby allowing the lift cord to unwrap from the cord spool and simultaneously the compression spring 210 slides the cord spool to the left allowing for a smooth and dependable unwrapping of the lift cord from the cord spool.

The compression spring 210 is desirable to a dependable operation of the lift system since it is desirable that the cord spool 206 always be returned to its far left hand position of FIG. 3A when the covering is down and fully extended. Otherwise, a cord might be wrapped on the cord spool commencing at a location other than the far right hand end of the cord spool and if the cord is long enough, and the cord spool is not long enough, there will not be enough space on the spool to receive the cord. For that reason, it is desirable that the cord spool always be fully returned to its far left hand position which is accomplished with the compression spring.

As will be appreciated from the description above, the control system 20 of the present invention uniquely permits an architectural covering to be raised through a reciprocating pulling motion on a single pull tape, cord, or handle. Depending upon the height of the shade, the reciprocating motion will cause the shade to be raised in increments only when the drive spool is being rotated in the first direction. The covering, of course, is prevented from inadvertently or undesirably dropping when it is not being raised by the brake/clutch assembly so that repeated pulling and retracted motions on the pull tape will cause the covering to be raised any desired amount from a partial retraction to a full retraction. Similarly, the covering can be selectively lowered any desired amount by releasing the brake until the shade has been lowered by gravity any desired amount from a partial lowering to a full extension. A desired feature of the control system resides in the fact that the pull tape is a single element that reduces the risk of harming infants which is a problem with conventional closed loop pull cords or pull cords having interconnected free ends.

It will also be appreciated that the pull tape can be allowed to be fully rewound onto the tape spool, which would leave the free end of the tape at an elevated location adjacent to the headrail where there would be no depending tape, or the tape could be knotted or otherwise modified at an intermediate location along the length of the tape to prevent a full retraction. Allowing a portion of the tape to hang downwardly from the headrail may more desirably position the tape for operation of the control system.

Although the present invention has been described with a certain degree of particularity, it is understood that the present disclosure has been made by way of example, and changes in detail or structure may be made without departing from the spirit of the invention as defined in the appended claims.

I claim:

1. An apparatus for unidirectionally driving a driven member comprising in combination:

a pull system operatively connected to an output shaft to effect unidirectional driven rotation of said driven member, said pull system including a flexible pull element and a rotatable spool around which said pull element is selectively wound, and a one-way spring clutch operatively connecting said spool to said output shaft to effect unidirectional driven rotation of said driven member, and wherein said spool includes a substantially cylindrical drive member having a first outside diameter and forming part of said spring clutch, said spring clutch further including a driven member of substantially cylindrical configuration having a second outside diameter slightly smaller than said first outside diameter, a fixed member having a substantially cylindrical cavity with a first inside diameter and a coil spring having a second inside diameter that is slightly smaller than said first outside diameter and a third outside diameter that is slightly greater than said first inside diameter, said driven member being selectively rotatable about its longitudinal axis relative to said drive member and said fixed member, said drive member being selectively rotatable about its longitudinal axis relative to said fixed member and said driven member and said drive member being rotatable in unison with said spool, whereby rotation of said drive member in a first direction causes said coil spring to be reduced in inside and outside diameter so that said spring is released from engagement with said fixed member and becomes frictionally engaged with said driven member to cause said driven member to rotate with said drive member, and rotation of said driven member in an opposite direction causes said coil spring to be enlarged in inside and outside diameter so that said spring is released from frictional engagement with said drive member allowing said drive member to rotate independently of said fixed member and driven member.

2. The apparatus of claim 1 wherein said spool further includes a biasing member biasing the spool in one rotative direction while yieldingly resisting movement of the spool in the other rotative direction.

3. The apparatus of claim 1 wherein said driven member is generally cylindrical in configuration with a plurality of discreet segments of varying outer diameters.

4. The apparatus of claim 1 wherein said drive spool and driven member are co-axial.

5. The apparatus of claim 3 wherein said driven element further includes a hollow interior having a plurality of discreet cylindrical cavities of varying diameters.

6. The apparatus of claim 5 wherein the largest diameter cylindrical cavity in the driven member is supported on the drive spool and another cavity within the driven member supports another portion of the drive spool.

* * * * *